US012313069B2

(12) United States Patent
Nagata et al.

(10) Patent No.: US 12,313,069 B2
(45) Date of Patent: May 27, 2025

(54) SCREW COMPRESSOR

(71) Applicant: Hitachi Industrial Equipment Systems Co., Ltd., Tokyo (JP)

(72) Inventors: Shuhei Nagata, Tokyo (JP); Shigeyuki Yorikane, Tokyo (JP); Kenji Morita, Tokyo (JP); Yuta Kajie, Tokyo (JP); Kotaro Chiba, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 18/273,848

(22) PCT Filed: May 27, 2022

(86) PCT No.: PCT/JP2022/021846

§ 371 (c)(1),
(2) Date: Jul. 24, 2023

(87) PCT Pub. No.: WO2022/255275

PCT Pub. Date: Dec. 8, 2022

(65) Prior Publication Data

US 2025/0075698 A1 Mar. 6, 2025

(30) Foreign Application Priority Data

Jun. 1, 2021 (JP) ..... 2021-092296

(51) Int. Cl.
*F04C 2/16* (2006.01)
*F04C 15/00* (2006.01)

(52) U.S. Cl.
CPC ..... *F04C 2/16* (2013.01); *F04C 15/0038* (2013.01); *F04C 15/0088* (2013.01); *F04C 2240/50* (2013.01); *F04C 2240/60* (2013.01)

(58) Field of Classification Search
CPC .... F04C 2/16; F04C 15/0038; F04C 15/0088; F04C 18/16; F04C 27/009; F04C 29/0007;

(Continued)

(56) References Cited

U.S. PATENT DOCUMENTS

2008/0152524 A1 6/2008 Kishi et al.
2010/0089078 A1 4/2010 Kishi et al.

(Continued)

FOREIGN PATENT DOCUMENTS

JP 57-135292 A 8/1982
JP 2002-21758 A 1/2002

(Continued)

OTHER PUBLICATIONS

JPS57135292 A—Saitou et al.,—Screw Compressor—Aug. 20, 1982—the English Machine Translation. (Year: 1982).*

(Continued)

*Primary Examiner* — Theresa Trieu
(74) *Attorney, Agent, or Firm* — Crowell & Moring LLP

(57) ABSTRACT

A screw compressor has first and second screw rotors that suck, compress, and deliver a working medium; a first bearing supporting one end of the first screw rotor coupled to a rotating shaft of a power source; a casing housing the first screw rotor and first bearing; a shaft-sealing member located on an opposite side of a tooth profiler for the first screw rotor relative to the first bearing and seals a through hole in the casing, through which a shaft of the first screw rotor coupled to the output shaft of the power source is inserted; a partition wall isolating the first bearing from the shaft-sealing member; and a liquid-supply route that is provided in the casing and has a first liquid supply opening for supplying a lubricating liquid to the shaft-sealing member and a second liquid supply opening for supplying the lubricating liquid to the first bearing.

6 Claims, 8 Drawing Sheets

(58) Field of Classification Search
CPC ..... F04C 29/02; F04C 29/028; F04C 29/042; F04C 2240/50; F04C 2240/52; F04C 2240/60
See application file for complete search history.

(56) References Cited

U.S. PATENT DOCUMENTS

| | | | | |
|---|---|---|---|---|
| 2018/0023571 | A1* | 1/2018 | Endo | F04C 29/021 418/202 |
| 2018/0238329 | A1* | 8/2018 | Kasahara | F04C 18/16 |
| 2019/0072093 | A1* | 3/2019 | Tajima | F04C 29/026 |

FOREIGN PATENT DOCUMENTS

| | | | | |
|---|---|---|---|---|
| JP | 2013104327 | A * | 5/2013 | F04C 18/16 |
| WO | WO 2007/000815 | A1 | 1/2007 | |
| WO | WO-2020084916 | A1 * | 4/2020 | F04C 18/16 |

OTHER PUBLICATIONS

International Search Report (PCT/ISA/210) issued in PCT Application No. PCT/JP2022/021846 dated Aug. 2, 2022 with English translation (4 pages).
Japanese-language Written Opinion (PCT/ISA/237) issued in PCT Application No. PCT/JP2022/021846 dated Aug. 2, 2022 (3 pages).
European Search Report issued in European Application No. 22816023.0 dated Mar. 13, 2025 (8 pages).

* cited by examiner

SCREW COMPRESSOR

TECHNICAL FIELD

The present invention relates to a screw compressor and is suited for application to a screw compressor including a liquid supplying mechanism.

BACKGROUND ART

Conventionally, there has been known an oil-cooling-type screw compressor disclosed by PTL 1 as a screw compressor. This screw compressor has a structure such that: it has an oil supply hole for supplying lubricating oil to a space in which a suction bearing and a mechanical seal are stored; and a first collection hole is formed in a partition wall between a screw rotor and a suction-side bearing and a second collection hole is further formed by bypassing the first collection hole, and these first and second collection holes are also open to a compressed air suction passage.

Because of the above-described structure, the screw compressor disclosed by PTL 1 is designed so that part of the lubricating oil is collected through the second collection hole, thereby minimizing an amount of the lubricating oil, which passes through the suction-side bearing, as required for lubrication purpose and making it possible to reduce stirring loss of the suction-side bearing.

CITATION LIST

Patent Literature

PTL 1: Japanese Patent Application Laid-Open (Kokai) Publication No. 2002-21758

SUMMARY OF THE INVENTION

Problems to be Solved by the Invention

Meanwhile, with the screw compressor disclosed by PTL 1, the bearing is lubricated through the process of part of the lubricating oil accumulated in the space, in which the suction-side bearing and the mechanical seal are stored, passing through the suction-side bearing and being collected in the first collection hole.

Accordingly, the structure is in principle designed so that the suction-side bearing stirs the lubricating oil, which has accumulated in the space, and also stirs the lubricating oil which passes through the suction-side bearing, thereby resulting in a problem of large stirring loss which is caused particularly by stirring of the lubricating oil accumulated in the space, wherein the large stirring loss causes degradation of performance as the compressor.

The present invention was devised in consideration of the above-described circumstances and aims at proposing a highly reliable and highly efficient screw compressor capable of effectively preventing the degradation of performance as the compressor.

Means to Solve the Problems

In order to solve the above-described problems, there is provided according to the present invention a screw compressor for compressing a working medium, which is designed to be provided with: first and second screw rotors that suck, compress, and deliver the working medium; a first bearing that freely rotatably supports one end side of the first screw rotor whose one end side is coupled to a rotating shaft of a power source; a casing that houses the first screw rotor and the first bearing; a shaft sealing member that is located on an opposite side of a tooth profile unit for the first screw rotor relative to the first bearing inside the casing and seals a through hole in the casing, through which a shaft of the first screw rotor coupled to the output shaft of the power source is inserted; a partition wall that isolates the first bearing from the shaft sealing member inside the casing; and a liquid supply route that is provided in the casing and has a first liquid supply opening for supplying a lubricating liquid to the shaft sealing member and a second liquid supply opening for supplying the lubricating liquid to the first bearing.

As a result, an appropriate amount of the lubricating liquid can be supplied to the shaft sealing member and the first bearing respectively independently. Consequently, it is possible to suppress the stirring loss of the lubricating liquid at the first bearing which is attributable to the supply of an excessive amount of the lubricating liquid to the first bearing.

Advantageous Effects of the Invention

The highly reliability and highly efficient screw compressor can be realized according to the present invention.

DESCRIPTION OF EMBODIMENTS

One embodiment of the present invention will be described below in detail with reference to the drawings.

(1) First Embodiment

Figure 1:
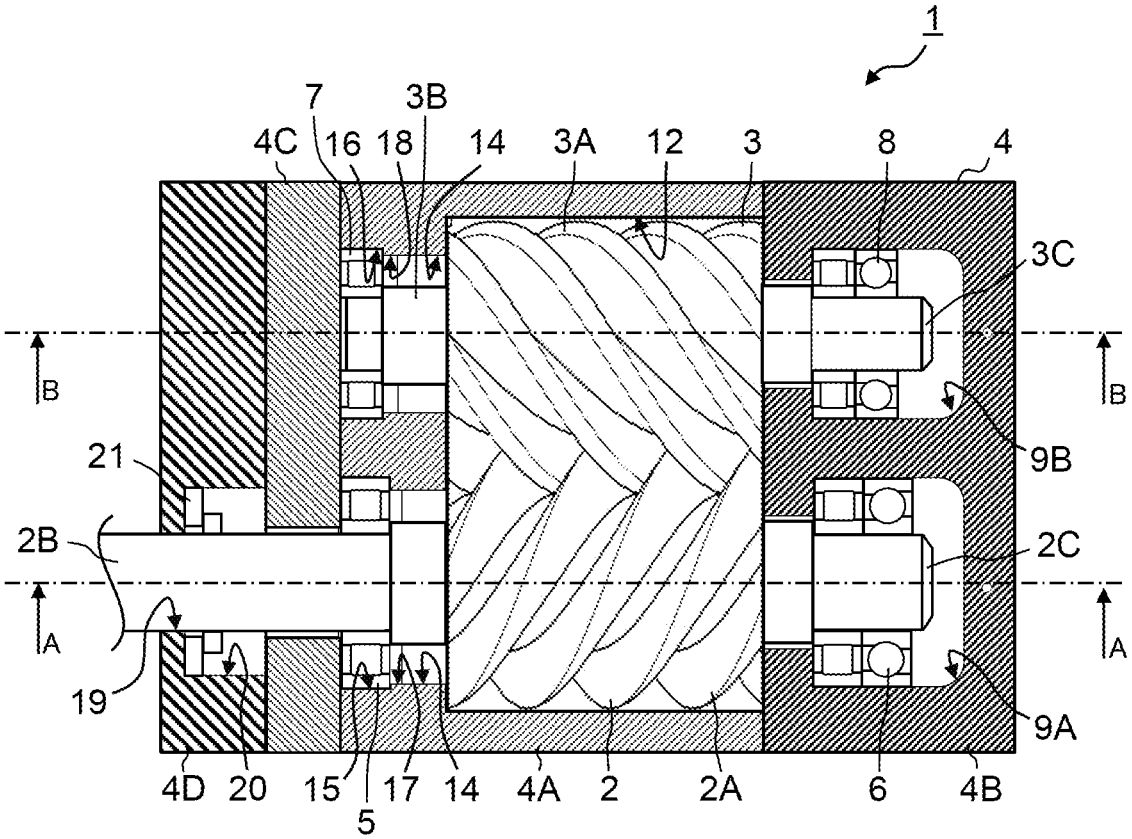
FIG. 1 is a horizontal-direction sectional view illustrating a male-rotor-side configuration of a screw compressor according to a first embodiment.
Figure 2:
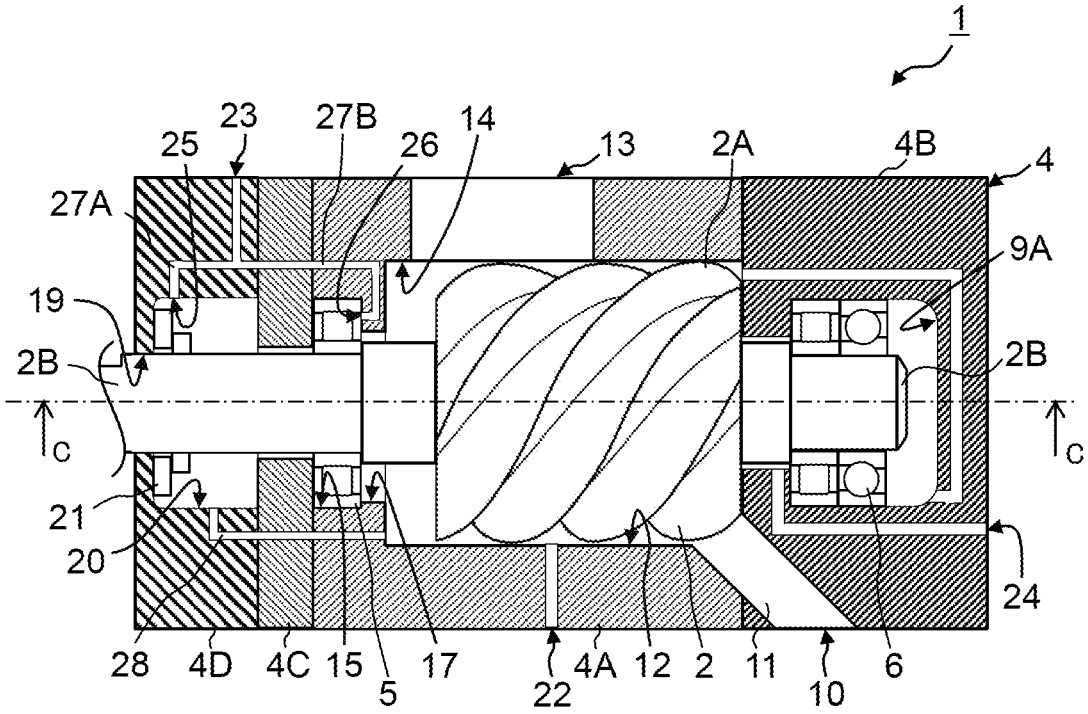
FIG. 2 is a vertical-direction sectional view illustrating the male-rotor-side configuration of the screw compressor according to the first embodiment.

FIG. 1 and FIG. 2 illustrate a screw compressor 1 according to a first embodiment. FIG. 1 is a diagram taken along line C-C indicated with arrows in FIG. 2 (a horizontal sectional view) and FIG. 2 is a diagram taken along line A-A indicated with arrows in FIG. 1 (a vertical sectional view).

The screw compressor 1 according to this embodiment is configured, as illustrated in FIG. 1 and FIG. 2, by including a male rotor 2 and a female rotor 3 which constitute a pair of screw rotors, and a casing 4 for housing the male rotor 2 and the female rotor 3.

The male rotor 2 is configured by including a tooth profile unit 2A on which a plurality of spirally extending teeth (lobes) are formed, a suction-side shaft 2B formed on one end side (the left side in FIG. 1 and FIG. 2 and the same applies hereinafter) of the tooth profile unit 2A in its rotor shaft direction, and a delivery-side shaft 2C on the other end side (the right side in FIG. 1 and FIG. 2 and the same applies hereinafter) of the tooth profile unit 2A in its rotor shaft direction. The suction-side shaft 2B of the male rotor 2 is freely rotatably supported by a suction-side bearing (hereinafter referred to as a "first suction-side bearing") 5 and the delivery-side shaft 2C of the male rotor 2 is freely rotatably supported by a delivery-side bearing (hereinafter referred to as a "first delivery-side bearing") 6.

Similarly, the female rotor 3 is configured by including a tooth profile unit 3A with a plurality of lobes formed thereon which mesh with the lobes of the male rotor 2, a suction-side shaft 3B formed on one end side of the tooth profile unit 3A in its rotor shaft direction, and a delivery-side shaft 3C formed on the other end side of the tooth profile unit 3A in its rotor shaft direction. The suction-side shaft 3B of the female rotor 3 is freely rotatably supported by a suction-side bearing (hereinafter referred to as a "second suction-side bearing") 7 and the delivery-side shaft 3C of the female rotor 3 is freely rotatably supported by the delivery-side bearing (hereinafter referred to as a "second delivery-side bearing") 8.

The suction-side shaft 2B of the male rotor 2 pierces through the casing 4 and is coupled to a rotating shaft of a motor which is not illustrated in the drawing. Accordingly, by driving the motor, the male rotor 2 can be rotatably driven integrally with the rotating shaft of the motor; and accordingly, the female rotor 3 can be also rotatably driven integrally with the male rotor 2.

The casing 4 is composed of a main casing 4A, a delivery-side casing 4B coupled to the other end side of the main casing 4A in its rotor shaft direction, and a suction-side casing 4D coupled via a suction-side partition wall 4C to one end side of the main casing 4A in its rotor shaft direction.

The delivery-side casing 4B is provided with a first delivery-side bearing housing space 9A and a second delivery-side bearing housing space 9B which are provided mutually independently; and the first delivery-side bearing 6 is housed in the first delivery-side bearing housing space 9A and the second delivery-side bearing 8 is housed in the second delivery-side bearing housing space 9B. Moreover, a delivery opening 10 positioned outside the tooth profile units 2A, 3A of the male rotor 2 and the female rotor 3 in their rotor diameter direction (the lower side in FIG. 2) and a delivery passage 11 which connects the delivery opening 10 and a bore 12 described later are formed in the delivery-side casing 4B.

The bore 12 which houses the tooth profile unit 2A of the male rotor 2 and the tooth profile unit 3A of the female rotor 3 is formed in the main casing 4A. The bore 12 is a space, which has a shape of two cylindrical holes partially overlapping with each other, for housing the tooth profile unit 2A of the male rotor 2 and the tooth profile unit 3A of the female rotor 3 in a state of their lobes meshing with each other.

A working chamber is formed of an inner wall surface of the bore 12, a groove of the male rotor 2, and a groove of the female rotor 3. The working chamber is formed so that its volume gradually decreases from its one end side to the other end side in the rotor shaft direction. Accordingly, the working medium such as air sucked through a suction opening 13 is gradually compressed in the working chamber and is then delivered from the delivery opening 10 through the delivery passage 11.

The suction opening 13 is formed outside in the rotor diameter direction of the tooth profile unit 2A of the male rotor 2 and the tooth profile unit 3A of the female rotor 3 in the main casing 4A (the upper side in FIG. 2). The suction opening 13 is connected to the working chamber via a suction space 14 to allow communication therebetween and the working medium sucked through the suction opening 13 passes through the suction space 14 and is supplied to the working chamber via the suction space 14.

A cylindrical first suction-side bearing housing space 15 and a cylindrical second suction-side bearing housing space 16 are formed in an end face on the one end side of the main casing 4A in the rotor shaft direction. Then, the first suction-side bearing 5 is housed in the first suction-side bearing housing space 15 so that first suction-side bearing 5 is fitted into the first suction-side bearing housing space 15; and the second suction-side bearing 7 is housed in the second suction-side bearing housing space 16 so that the second suction-side bearing 7 is fitted into the second suction-side bearing housing space 16.

Moreover, a first bearing communicating space 17 which has a slightly smaller diameter than that of the first suction-side bearing housing space 15 and connects the first suction-side bearing housing space 15 and the suction space 14 to allow communication therebetween, and a second bearing communicating space 18 which has a slightly smaller diameter than that of the second suction-side bearing housing space 16 and connects the second suction-side bearing housing space 16 and the suction space 14 to allow communication therebetween are formed in the main casing 4A.

Furthermore, the suction-side partition wall 4C is secured to the end face on the one end side of the main casing 4A in the rotor shaft direction and the suction-side casing 4D is secured to an end of this suction-side partition wall 4C in the rotor shaft direction. Then, a shaft sealing space 20 which is connected to a through hole 19, into which the suction-side shaft 2B of the male rotor 2 is inserted, to allow communication therebetween is formed on a surface opposite the suction-side partition wall 4C and a shaft sealing member 21 for sealing the through hole 19 is disposed inside this shaft sealing space 20.

In addition, the casing 4 of this screw compressor 1 is provided with a first working chamber liquid supply opening 22 which is connected to the working chamber inside the bore 12 to allow communication therebetween, so that liquid can be injected into the working chamber through this first working chamber liquid supply opening 22. Moreover, a first suction-side liquid supply opening 23 is provided on the suction opening 13 side of the casing 4 and a first delivery-side liquid supply opening 24 is provided on the delivery opening 10 side of the casing 4, so that a liquid can be injected into the shaft sealing space 20 and into the first suction-side bearing housing space 15, respectively, through the first suction-side liquid supply opening 23 and the liquid can be injected into the first delivery-side bearing housing space 9A through the first delivery-side liquid supply opening 24.

The purpose of the above-described injection of the liquid to the working chamber, the shaft sealing space 20, the first suction-side bearing housing space 15, and the first delivery-side bearing housing space 9A is to cool mechanism components and compressed air, lubricate the first suction-side bearing 5 and the first delivery-side bearing 6, and enhance sealability by the shaft sealing member 21; and oil or water is applied as the liquid to be then injected. This liquid will be hereinafter referred to as a "lubricating liquid."

The lubricating liquid injected into the first suction-side liquid supply opening 23 passes through inside of the casing 4 and is emitted through a first liquid supply opening 25 into the shaft sealing space 20 and is also emitted through a second liquid supply opening 26 into the first suction-side bearing housing space 15.

Figure 3:
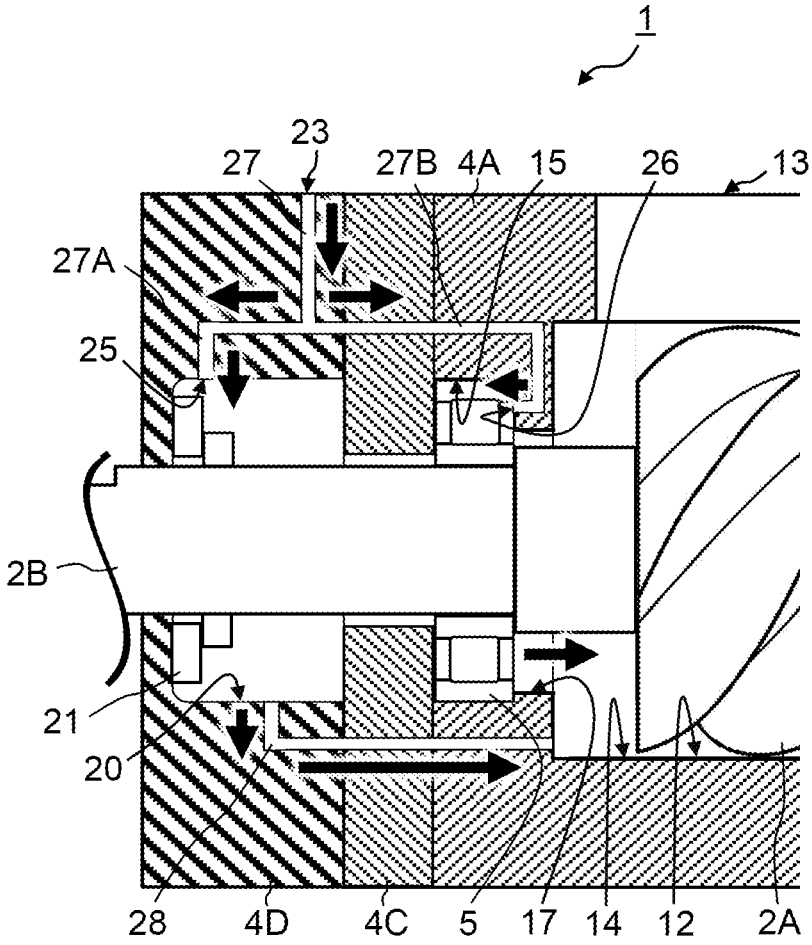
FIG. 3 is a vertical-direction sectional view illustrating the configuration of a liquid supply route on the male rotor side of the screw compressor according to the first embodiment.

FIG. 3 illustrates a distribution route inside the casing 4 for the lubricating liquid supplied to the first suction-side bearing 5 and the shaft sealing member 21. Arrows in the drawing indicate liquid supply directions of the lubricating liquid. A first liquid supply route 27 which connects the first suction-side liquid supply opening 23 and the first and second liquid supply openings 25, 26 to allow communication therebetween is provided inside the casing 4 as illustrated in this FIG. 3. Moreover, the first liquid supply route 27 is formed so that it diverges into first and second branch paths 27A, 27B in the middle of the route and the first branch path 27A connects to the first liquid supply opening 25 to allow communication therebetween and the second branch path 27B connects to the second liquid supply opening 26 to allow communication therebetween.

In this case, the first liquid supply opening 25 is open toward the shaft sealing member 21 located inside the shaft sealing space 20. Accordingly, the lubricating liquid which is injected through the first suction-side liquid supply opening 23 into the casing 4 and then flows into the first branch path 27A is emitted from the first liquid supply opening 25 and then supplied to the shaft sealing member 21. Moreover, the shaft sealing space 20 is connected to the suction space 14 via a bypass communicating path 28 to allow communication therebetween. Accordingly, the lubricating liquid injected into the shaft sealing space 20 is discharged to the suction space 14 through the bypass communicating path 28.

On the other hand, the second liquid supply opening 26 is open toward the first suction-side bearing 5 which is housed in the first suction-side bearing housing space 15. Accordingly, the lubricating liquid which is injected through the first suction-side liquid supply opening 23 into the casing 4 and flows into the second branch path 27B is emitted from the second liquid supply opening 26 and is then supplied from the male rotor 2 side to the first suction-side bearing 5.

In this case, the first suction-side bearing 5 is partially exposed to the suction space 14 via the first bearing communicating space 17 of the main casing 4A, so that the lubricating liquid which is supplied from the second liquid supply opening 26 to the first suction-side bearing 5 flows out to the suction space 14 via the first bearing communicating space 17. Subsequently, this lubricating liquid joins the lubricating liquid, which has flown into the suction space 14 via the bypass communicating path 28, and is then delivered, together with the working medium which has flown into the suction space 14 through the suction opening 13, to the working chamber.

Now, stirring loss of the lubricating liquid at the first suction-side bearing 5 will be examined. In this embodiment, a roller bearing is assumed as the first suction-side bearing 5; however, the invention is not limited to this example and the first suction-side bearing 5 may be other antifriction bearings such as a ball bearing.

Generally, when an antifriction bearing rotates in the lubricating liquid, a rolling element within the antifriction bearing rolls while pushing away the lubricating liquid, and the rolling element thereby becomes subject to fluid resistance. Also, this embodiment has such a structure that the lubricating liquid supplied to the first suction-side bearing 5 is always replaced, so that the rolling element needs to perform work to accelerate the lubricating liquid which has newly flown in. A combination of these results in the stirring loss.

This embodiment has such a structure as is obvious from FIG. 3 that the position where the first suction-side bearing 5 is located is higher than the position of the lowest end of the suction space 14 and the lubricating liquid can be hardly accumulated. Also, when this screw compressor 1 is installed so that the male rotor 2 and the female rotor 3 are positioned horizontally as in FIG. 3, the first bearing communicating space 17 is formed so that the lowest end of the first bearing communicating space 17 becomes lower than a height position of the lowest end of an outer ring bore diameter of the first suction-side bearing 5; and, accordingly, it is structured so that the lubricating liquid inside a rolling element track unit of the first suction-side bearing 5 can be easily discharged.

Furthermore, for example, if the second liquid supply opening 26 is formed on the suction-side partition wall 4C side, the lubricating liquid which is supplied to the first suction-side bearing 5 through this second liquid supply opening 26 needs to pass through inside the rolling element track unit of the first suction-side bearing 5, which performs rotary motions, in order for this lubricating liquid to flow out to the suction space 14 side. So, the stirring loss will increase accordingly. On the other hand, in this embodiment, the second liquid supply opening 26 is formed so that the lubricating liquid can be supplied from the male rotor 2 side to the first suction-side bearing 5; and, therefore, the entire lubricating liquid supplied to the first suction-side bearing 5 does not have to pass through the rolling element track unit of the first suction-side bearing 5 which performs the rotary motions. Consequently, it can be said that this screw compressor 1 has the structure with small stirring loss of the lubricating liquid in the rolling element track unit of the first suction-side bearing 5.

Next, an explanation will be provided about a liquid supply amount of the lubricating liquid to the shaft sealing member 21 and the first suction-side bearing 5. As described in the aforementioned PTL 1, a required amount of the lubricating liquid at the first suction-side bearing 5 is generally smaller than that at the shaft sealing member 21 such as a mechanical seal.

Regarding this point, with the screw compressor 1 according to this embodiment, the first suction-side bearing housing space 15 which houses the first suction-side bearing 5, and the shaft sealing space 20 in which the shaft sealing member 21 is disposed are isolated from each other by the suction-side partition wall 4C and the first liquid supply opening 25 for supplying the lubricating liquid to the shaft sealing member 21 and the second liquid supply opening 26 for supplying the lubricating liquid to the first suction-side bearing 5 are provided independently, so that an appropriate amount of the lubricating liquid can be supplied respectively to the shaft sealing member 21 and the first suction-side bearing 5.

Allocations of the liquid supply amount of the lubricating liquid to the shaft sealing member 21 and the first suction-side bearing 5 can be decided by pressure loss of the first liquid supply route 27 and, specifically speaking, can be decided according to the lengths and hydraulic diameters of the first and second branch paths 27A, 27B, and diameters of the first and second liquid supply openings 25, 26. In this embodiment, the supply amount of the lubricating liquid required for the shaft sealing member 21 as described above is larger than the supply amount of the lubricating liquid required for the first suction-side bearing 5, so that the lengths and hydraulic diameters of the first and second branch paths 27A, 27B and the diameters of the first and second liquid supply openings 25, 26 are selected to make the pressure loss from the first suction-side liquid supply opening 23 to the first liquid supply opening 25 become smaller than the pressure loss from the first suction-side liquid supply opening 23 to the second liquid supply opening 26.

Figure 4:
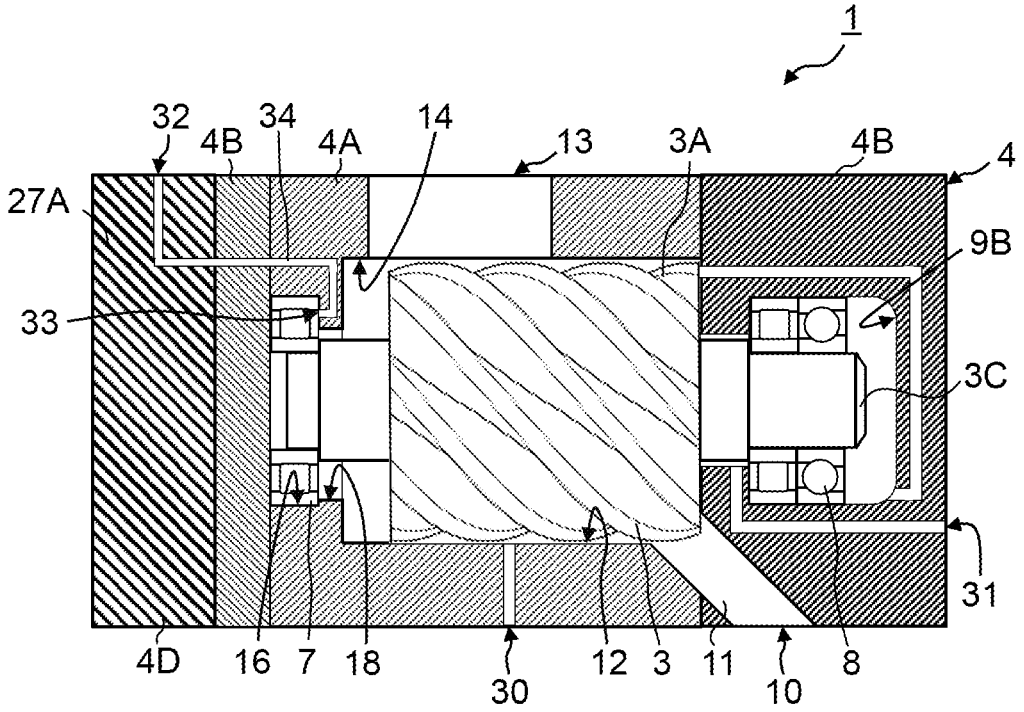
FIG. 4 is a vertical-direction sectional view illustrating a female-rotor-side configuration of the screw compressor according to the first embodiment.

FIG. 4 is a diagram taken along line B-B indicated with arrows in FIG. 1 (a vertical sectional view). The main casing 4A is provided with a second working chamber liquid supply opening 30 which is connected to the working chamber in the bore 12 to allow communication therebetween, so that it is designed to enable the lubricating liquid to be supplied from outside the screw compressor 1 through the second working chamber liquid supply opening 30 to the working chamber.

Additionally, a second delivery-side liquid supply opening 31 is formed in the delivery-side casing 4B, so that it is designed to enable the lubricating liquid to be supplied to the second delivery-side bearing 8, which is disposed within the second delivery-side bearing housing space 9B, through this second delivery-side liquid supply opening 31.

Furthermore, a second suction-side liquid supply opening 32 is formed outside in the rotor diameter direction of the suction-side casing 4D and the main casing 4A is provided with a third liquid supply opening 33 toward the second suction-side bearing 7, which is housed in the second suction-side bearing housing space 16, and the third liquid supply opening 33 is connected to the second suction-side liquid supply opening 32 to allow communication therebetween via a second liquid supply route 34 formed inside the casing 4. Accordingly, it is designed so that this lubricating liquid can be supplied from the third liquid supply opening 33 to the second suction-side bearing 7 by way of the second liquid supply route 34 by injecting the lubricating liquid into the screw compressor 1 through the second suction-side liquid supply opening 32.

In this case, the second suction-side bearing 7 is partially exposed to the suction space 14 via the second bearing communicating space 18 of the main casing 4A, the lubricating liquid which is supplied from the second suction-side liquid supply opening 32 via the second liquid supply route 34 to the second suction-side bearing 7 flows out to the suction space 14 via the second bearing communicating space 18 and is then delivered to the working chamber together with the working medium which has flown from the suction opening 13 into the suction space 14.

By configuring the second liquid supply route 34 as described above, it is possible to keep the stirring loss of the lubricating liquid small at the second suction-side bearing 7 by means of the mechanism similar to that of the stirring loss of the lubricating liquid at the first suction-side bearing 5.

Incidentally, the second working chamber liquid supply opening 30, the second suction-side liquid supply opening 32, and the second delivery-side liquid supply opening 31 may be formed respectively separately from their corresponding openings, that is, the first working chamber liquid supply opening 22, the first suction-side liquid supply opening 23, and the first delivery-side liquid supply opening 24 described earlier with reference to FIG. 2, or may be provided at the same positions as those of the above-mentioned openings. In other words, the first and second working chamber liquid supply openings 22, 30, the first and second suction-side liquid supply openings 23, 32, and the first and second delivery-side liquid supply openings 24, 31 may be respectively the same openings.

Figure 5:
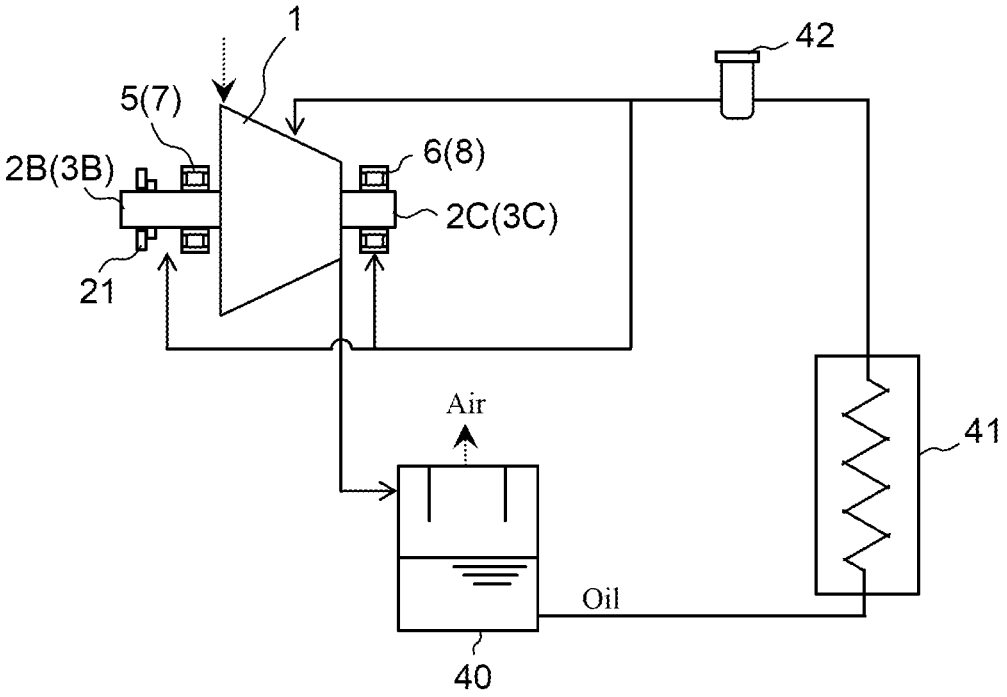
FIG. 5 is a conceptual diagram for explaining an external route for a lubricating liquid injected into the screw compressor according to the first embodiment.

FIG. 5 illustrates an external route for the lubricating liquid injected into the screw compressor 1 according to this embodiment. The lubricating liquid injected into the screw compressor 1 is delivered through the delivery opening 10 (FIG. 2 and FIG. 4) in a state of being mixed into the working medium compressed by the screw compressor 1. Then, after this lubricating liquid is separated from the working medium, which is compressed by an oil separator 40, and is cooled by a cooler 41, the lubricating liquid goes through an oil filter (and a check valve) 42 and is then given to the first and second working chamber liquid supply openings 22, 30 (FIG. 2 and FIG. 4) and is injected into the working chamber through these first and second working chamber liquid supply openings 22, 30, respectively.

Furthermore, after passing through the oil filter 42, the lubricating liquid is made to diverge, is given to the first and second suction-side liquid supply openings 23, 32 (FIG. 2 and FIG. 4) and also the first and second delivery-side liquid supply openings 24, 31 (FIG. 2 and FIG. 4), and is also supplied, through the first suction-side liquid supply opening 23, to the shaft sealing member 21 (FIG. 2) inside the shaft sealing space 20 (FIG. 2), to the first suction-side bearing 5 inside the first suction-side bearing housing space 15 (FIG. 2), to the second suction-side bearing 7 inside the first suction-side bearing housing space 15 (FIG. 2), to the first delivery-side bearing 6 (FIG. 1) which is housed in the first delivery-side bearing housing space 9A (FIG. 1), and to the second delivery-side bearing 8 (FIG. 1) which is housed in the second delivery-side bearing housing space 9B (FIG. 1), respectively. Incidentally, the divergence of the lubricating liquid is not limited to outside the screw compressor 1 as illustrated in FIG. 5, but the lubricating liquid may diverge inside the casing 4 of the screw compressor 1.

With the screw compressor 1 according to this embodiment which has the above-described configuration, the first suction-side bearing housing space 15 which houses the first suction-side bearing 5, and the shaft sealing space 20 in which the shaft sealing member 21 is disposed are isolated from each other by the suction-side partition wall 4C and the first liquid supply opening 25 for supplying the lubricating liquid to the shaft sealing member 21 and the second liquid supply opening 26 for supplying the lubricating liquid to the first suction-side bearing 5 are provided independently, so that an appropriate amount of the lubricating liquid can be supplied independently to the shaft sealing member 21 and the first suction-side bearing 5, respectively. Therefore, if this screw compressor 1 is employed, it is possible to suppress the stirring loss of the lubricating liquid at the first suction-side bearing 5, which is attributable to the supply of an excessive amount of the lubricating liquid to the first suction-side bearing 5, and it is thereby possible to realize the highly reliable and highly efficient screw compressor.

Furthermore, with this screw compressor 1, the second liquid supply opening 26 is formed so that the lubricating liquid can be supplied from the male rotor 2 side to the first suction-side bearing 5. So, the entire lubricating liquid supplied to the first suction-side bearing 5 does not have to pass through the rolling element track unit of the first suction-side bearing 5 which performs rotary motions. Consequently, if this screw compressor 1 is employed, it is possible to realize the screw compressor which has small stirring loss of the lubricating liquid at the first suction-side bearing 5 and which is more highly efficient.

(2) Second Embodiment

Figure 6:
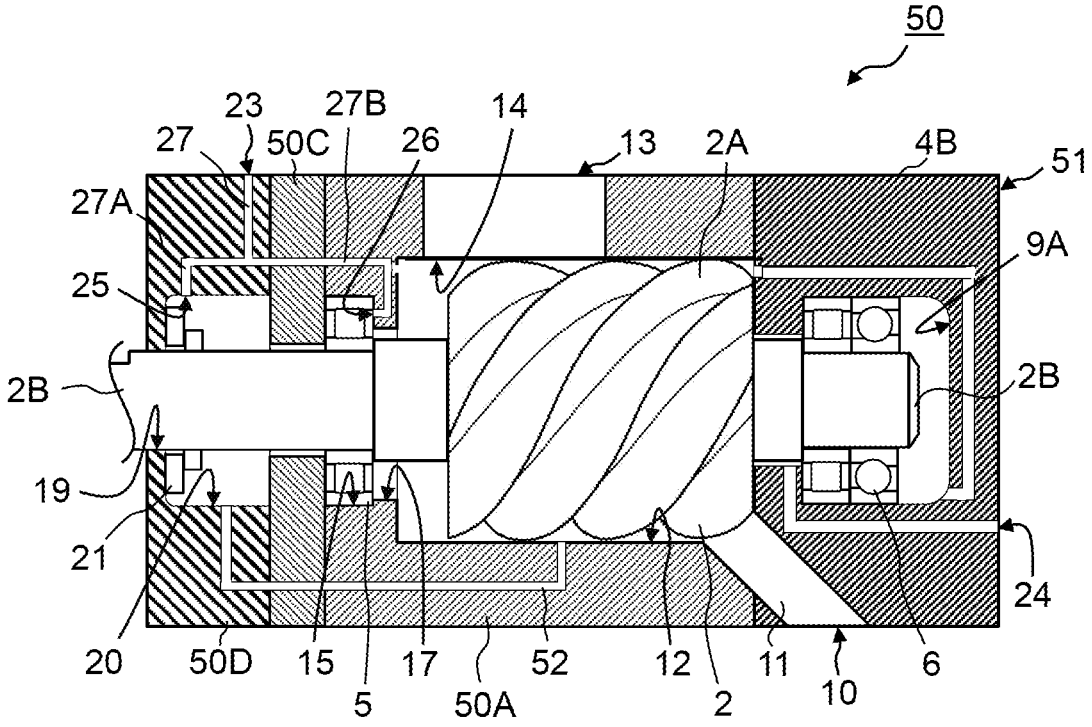
FIG. 6 is a vertical-direction sectional view illustrating a male-rotor-side configuration of a screw compressor according to a second embodiment.

FIG. 6 in which the same reference numerals as those in FIG. 2 are assigned to parts corresponding to those in FIG. 2 illustrates a vertical cross section of a screw compressor 50 according to a second embodiment. The difference between this screw compressor 50 and the screw compressor 1 according to the first embodiment is that a bypass communicating path 52 is configured within a casing 51 (a suction-side casing 50D, a suction-side partition wall 50C, and a main casing 50A) to connect the shaft sealing space 20 and the bore 12 to allow communication therebetween.

Accordingly, this screw compressor 50 is not provided with the first working chamber liquid supply opening 22 (FIG. 2) in the main casing 50A or a route for connecting the first working chamber liquid supply opening 22 and the bore 12 to allow communication therebetween, so that the lubricating liquid which is supplied to the shaft sealing member 21 inside the shaft sealing space 20 is discharged via the bypass communicating path 52 to inside the bore 12.

If the screw compressor 50 having the above-described configuration according to this embodiment is employed, it is possible to supply a sufficient and required amount of the lubricating liquid to the first and second suction-side bearings 5, 7 and the shaft sealing member 21 and keep the stirring loss low at the first and second suction-side bearings 5, 7 in a manner similar to the screw compressor 1 according to the first embodiment. Therefore, the highly reliable and highly efficient screw compressor can be also provided according to this embodiment.

(3) Third Embodiment

Figure 7:
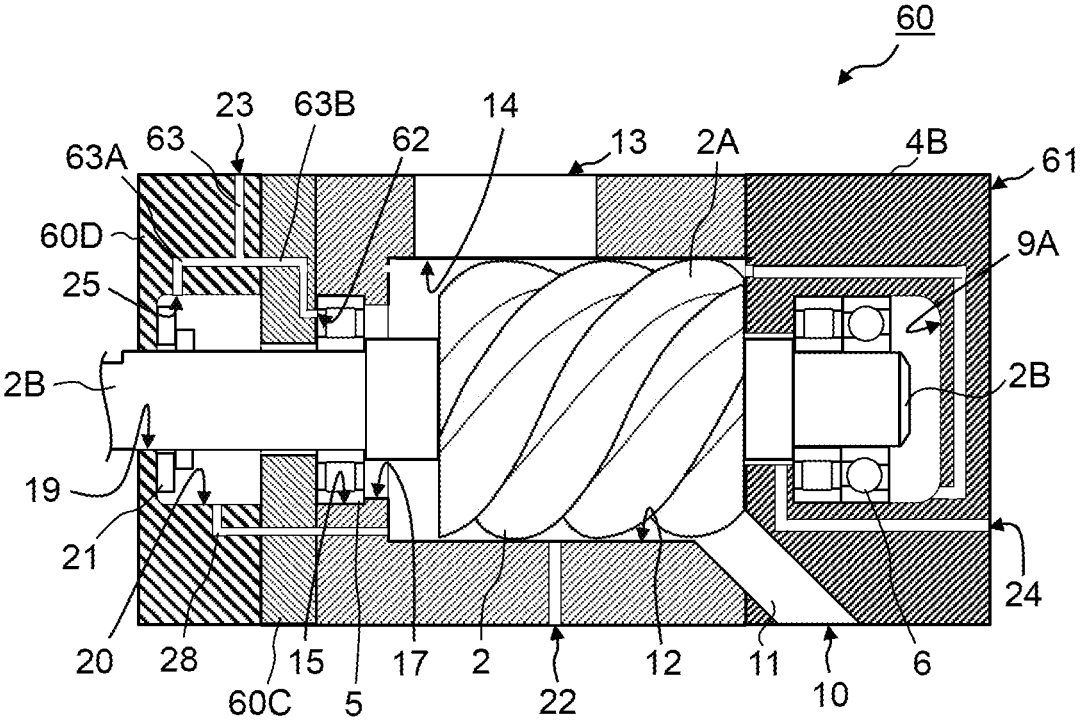
FIG. 7 is a vertical-direction sectional view illustrating a male-rotor-side configuration of a screw compressor according to a third embodiment.

FIG. 7 in which the same reference numerals as those in FIG. 2 are assigned to parts corresponding to those in FIG. 2 illustrates a vertical cross section of a screw compressor 60 according to a third embodiment. This screw compressor 60 is configured in a manner similar to the screw compressor 1 according to the first embodiment, except that the position of a second liquid supply opening 62 is different.

Practically, regarding the screw compressor 60 according to this embodiment, the second liquid supply opening 62 is provided in a suction-side partition wall 60C so that the lubricating liquid can be supplied from the suction-side partition wall 60C side to the first suction-side bearing 5; and a second branch path 63B of a first liquid supply route 63 is provided inside a suction-side casing 60D and the suction-side partition wall 60C so that the first liquid supply opening 62 and the first suction-side liquid supply opening 23 are connected to each other to allow communication therebetween.

Accordingly, with this screw compressor 60, the lubricating liquid which is supplied from the second liquid supply opening 62 to the first suction-side bearing 5 passes through the rolling element track unit of the first suction-side bearing 5 which performs rotary motions, so that the stirring loss at the first suction-side bearing 5 becomes larger than that of the screw compressor 1 according to the first embodiment.

However, this screw compressor 60 is provided with the first liquid supply opening 62 opposite on the suction-side partition wall 60C side relative to the first suction-side bearing 5, so that it is unnecessary to provide, at the main casing 4A, the part to provide the first liquid supply opening opposite the first suction-side bearing 5. As a result, it is possible to secure a large opening area for the first bearing communicating space 17. So, the lubricating liquid hardly stagnates at the rolling element track unit of the first suction-side bearing 5 and the stirring lost at the first suction-side bearing 5 can be kept low accordingly.

If the screw compressor 60 having the above-described configuration according to this embodiment is employed, it is possible to supply a sufficient and required amount of the lubricating liquid to the first suction-side bearing 5 and the shaft sealing member 21 and keep the stirring loss low at the first suction-side bearing 5 in a manner similar to the screw compressor 1 according to the first embodiment. Therefore, the highly reliable and highly efficient screw compressor can be also provided according to this embodiment.

(4) Fourth Embodiment

Figure 8:
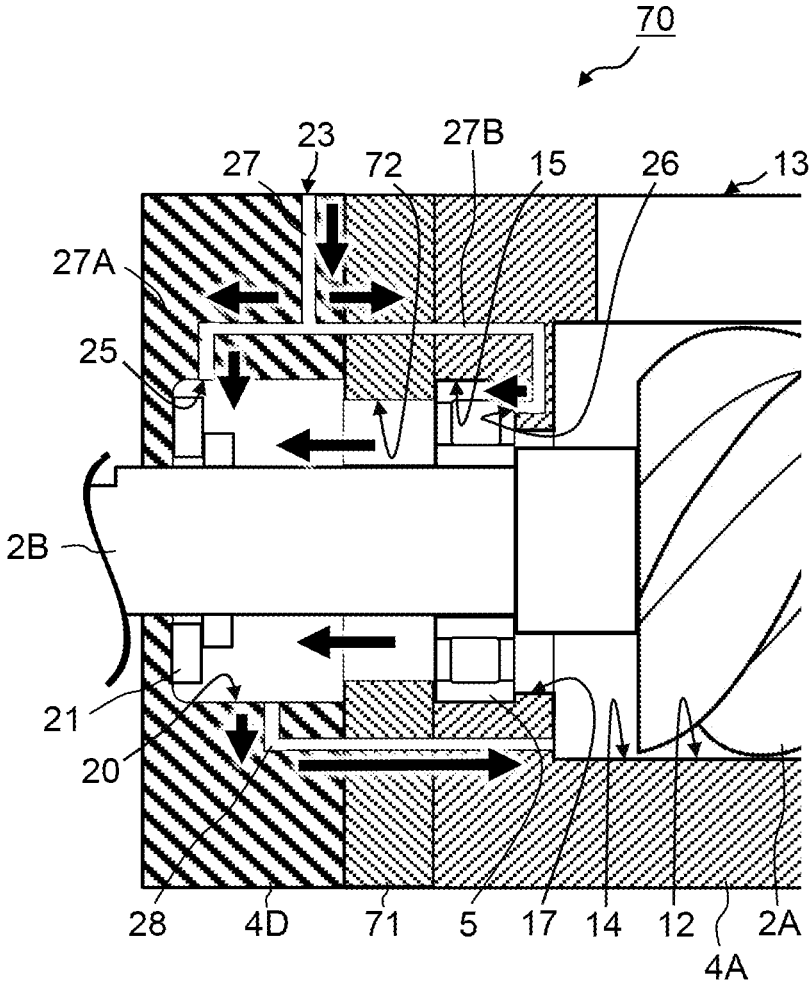
FIG. 8 is a vertical-direction sectional view illustrating a male-rotor-side configuration of a screw compressor according to a fourth embodiment.

FIG. 8 in which the same reference numerals as those in FIG. 3 are assigned to parts corresponding to those in FIG. 3 illustrates a vertical cross section of a partial configuration of a screw compressor 70 according to a fourth embodiment. This screw compressor 70 is configured in a manner similar to the screw compressor 1 according to the first embodiment, except that a through hole 72 which is designed to insert the suction-side shaft 2B of the male rotor 2 and is formed in a suction-side partition wall 71 is formed to be larger than that of the screw compressor 1 according to the first embodiment.

So, regarding the screw compressor 70 according to this embodiment, while most of the lubricating liquid supplied through the second liquid supply opening 26 to the first suction-side bearing 5 flows out to the suction space 14, part of the rest of the lubricating liquid passes through the first suction-side bearing 5, goes through the through hole 72 and flows into the shaft sealing space 20, and then joins the lubricating liquid, which has been supplied to the shaft sealing space 20 through the first liquid supply opening 25, and goes through the bypass communicating path 28 and is discharged to the suction space 14.

Accordingly, with this screw compressor 70, part of the lubricating liquid which has been supplied through the second liquid supply opening 26 to the first suction-side bearing 5 passes through the rolling element track unit of the first suction-side bearing 5 which performs the rotary motions, but the lubricating liquid which passes through the rolling element track unit of the first suction-side bearing 5 promptly flows into the shaft sealing space 20 through the through hole 72. So, the lubricating liquid hardly stagnates at the rolling element track unit of the first suction-side bearing 5 and the stirring lost at the first suction-side bearing 5 can be kept lower than that of the screw compressor 1 according to the first embodiment.

If the screw compressor 70 having the above-described configuration according to this embodiment is employed, it is possible to supply a sufficient and required amount of the lubricating liquid to the first suction-side bearing 5 and the shaft sealing member 21 and keep the stirring loss lower at the first suction-side bearing 5 than that of the screw compressor 1 according to the first embodiment. Therefore, the screw compressor which is highly reliable and more highly efficient can be also provided according to this embodiment.

(5) Other Embodiments

Incidentally, the aforementioned first to fourth embodiments have described the case where only the suction-side shaft of the male rotor 2 is connected to the rotating shaft of the motor as the power source; however, the present invention is not limited to this example and the present invention can be also applied to a screw compressor in the form where the suction-side bearing of the female rotor 3, instead of or in addition to the male rotor 2, is connected to the rotating shaft of the power source.

Moreover, the aforementioned first to fourth embodiments have described the case where the liquid supply route which is connected to the first liquid supply opening to allow communication therebetween (the first branch path), and the liquid supply route which is connected to the second liquid supply opening to allow communication therebetween (the second branch path) are configured to diverge inside the casing; however, the present invention is not limited to this example and these liquid supply routes may be originally formed separately (openings to which the liquid is supplied from outside may be formed separately).

Furthermore, the aforementioned third embodiment has described the case where the second liquid supply opening 62 is provided in the suction-side partition wall 60C so that the lubricating liquid can be supplied from the suction-side partition wall 60C side to the first suction-side bearing 5; however, the present invention is not limited to this example and the third liquid supply opening 26 described earlier with reference to FIG. 6 may be provided in the suction-side partition wall 60C so that the lubricating liquid can be also supplied from the suction-side partition wall 60C side to the second suction-side bearing 7.

INDUSTRIAL AVAILABILITY

The present invention can be applied to a wide variety of screw compressors with various configurations for compressing the working medium.

REFERENCE SIGNS LIST

1, 50, 60, 70: screw compressor
2: male rotor
2A, 3A: tooth profile units
2B, 3B: suction-side shafts
2C, 3C: delivery-side shafts
3: female rotor
4, 51: casing
5,7: suction-side bearings
6, 8: delivery-side bearings
9A, 9B: delivery-side bearing housing spaces
10: delivery opening
12: bore
13: suction opening
14: suction space
15, 16: suction-side bearing housing spaces
17, 18, 72: bearing communicating spaces
19: through hole
20: shaft sealing space
21: shaft sealing member
22, 30: working chamber liquid supply openings
23, 32: suction-side liquid supply openings
24, 31: delivery-side liquid supply openings
25, 26, 33, 62: liquid supply openings
27, 34, 63: liquid supply routes
27A, 27B, 63A, 63B: branch paths
28, 52: bypass communicating paths

The invention claimed is:

1. A screw compressor for compressing a working medium, comprising:

first and second screw rotors that suck, compress, and deliver the working medium;

a first bearing that freely rotatably supports one end side of the first screw rotor whose one end side is coupled to a rotating shaft of a power source;

a casing that houses the first screw rotor and the first bearing;

a shaft sealing member that is located on an opposite side of a tooth profile unit for the first screw rotor relative to the first bearing inside the casing and seals a through hole in the casing, through which a shaft of the first screw rotor coupled to the rotating shaft of the power source is inserted;

a partition wall that isolates the first bearing from the shaft sealing member inside the casing; and a liquid supply route that is provided in the casing and has a first liquid supply opening for supplying a lubricating liquid to the shaft sealing member and a second liquid supply opening for supplying the lubricating liquid to the first bearing.

2. The screw compressor according to claim 1, wherein the shaft sealing member is disposed in a first space provided in the casing;

wherein the first bearing is disposed in a second space provided in the casing;

wherein the tooth profile unit with lobes formed thereon in the screw rotor with its one end side coupled to the rotating shaft of the power source is housed in a third space;

wherein the first space is isolated from the second space by the partition wall;

wherein the first space is connected to the third space to allow communication therebetween via a bypass communicating path; and wherein the lubricating liquid supplied to the first space is discharged to the third space via the bypass communicating path.

3. The screw compressor according to claim 2, comprising a communicating space which connects the second space and the third space to allow communication therebetween, wherein the lubricating liquid which is supplied to the first bearing is discharged to the third space via the communicating space.

4. The screw compressor according to claim 3, wherein the communicating space is formed so that when the first rotor and the second screw rotor are installed horizontally, a lowest end of the communicating space becomes lower than a lower-end position of an outer ring bore diameter of the first bearing.

5. The screw compressor according to claim 1, wherein the first liquid supply opening is formed in the casing to supply the lubricating liquid to the first bearing from the screw rotor's side.

6. The screw compressor according to claim 1, comprising:

a second bearing that freely rotatably supports an one end side of the second screw rotor which is the same as the one end side of the first screw rotor coupled to the rotating shaft of the power source; and a third liquid supply opening provided in the casing to supply the lubricating liquid to the second bearing, wherein the third liquid supply opening is formed in the casing to supply the lubricating liquid from the screw rotors' side to the first bearing.

* * * * *